United States Patent [19]

Yoshiyuki

[11] 4,424,950

[45] Jan. 10, 1984

[54] EDGE MEMBER FOR MIRROR ASSEMBLIES

[75] Inventor: Hidetoshi Yoshiyuki, Bridgewater, N.J.

[73] Assignee: Takara Company, Somerset, N.J.

[21] Appl. No.: 246,856

[22] Filed: Mar. 23, 1981

[51] Int. Cl.[3] ..... A47F 7/14

[52] U.S. Cl. ..... 248/475 R

[58] Field of Search ..... 248/475 R, 487; 52/720, 52/798, 812, 786, 721, 731, 241, 238.1, 716, 710, 788, 213; 312/224, 226, 111

[56] References Cited

U.S. PATENT DOCUMENTS

| | | | |
|---|---|---|---|
| 1,988,124 | 1/1935 | Johnson | 52/710 |
| 3,013,642 | 12/1961 | Hammitt et al. | 52/238.1 |
| 3,023,859 | 3/1962 | Muessel | 52/720 |
| 3,196,998 | 7/1965 | Owen | 52/731 |
| 3,570,683 | 3/1971 | Dickgiesser | 52/710 X |
| 3,603,622 | 9/1971 | March | 52/710 X |
| 3,620,277 | 11/1971 | Tummarello | 52/710 X |
| 3,874,135 | 4/1975 | Craven | 52/720 X |
| 3,956,861 | 5/1976 | Rasmussen | 52/241 X |
| 4,258,964 | 3/1981 | Cowen et al. | 312/224 |
| 4,290,659 | 9/1981 | Yoshiyuki | 312/224 |

FOREIGN PATENT DOCUMENTS

| | | | |
|---|---|---|---|
| 650239 | 2/1951 | United Kingdom | 52/710 |

*Primary Examiner*—William H. Schultz
*Assistant Examiner*—Ramon O. Ramirez
*Attorney, Agent, or Firm*—Stephen E. Feldman; Jules L. Chaboty

[57] ABSTRACT

A decorative edge extrusion is provided for use with mirrors and the like in order to protect and support the mirrors. The edge extrusion also has provisions for interlocking with adjacent furniture modules to provide a continuous and supporting structure for the mirror assembly. The edge extrusion consists of a pair of shaped members interconnected by a web. The pair of shaped members fit over the edge of a mirror subassembly which is part of the mirror assembly. A channel is provided between the shaped members, opposite to the mirror assembly, for cooperating with a mounting bracket attached to adjacent furniture modules.

5 Claims, 3 Drawing Figures

FIG. 2
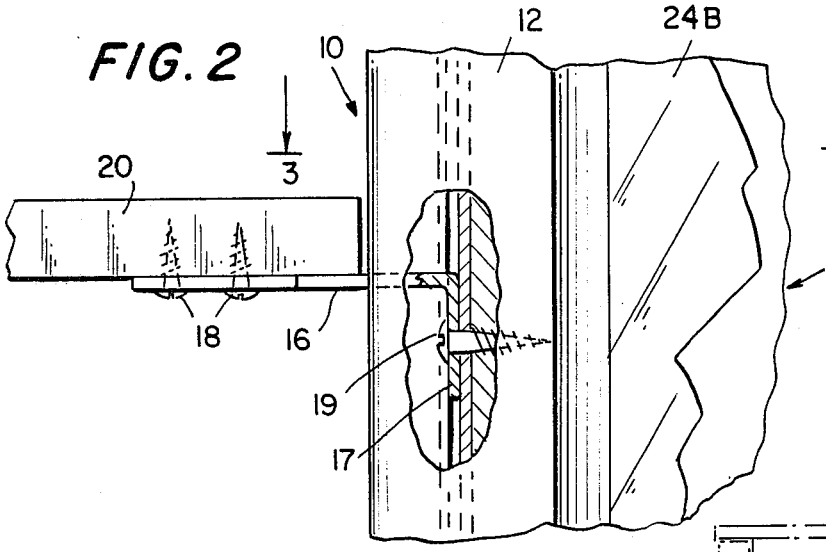
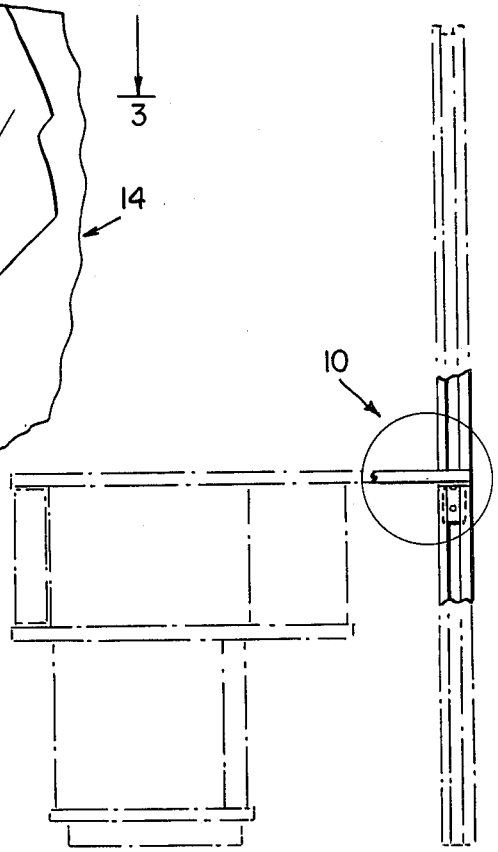
FIG. 1
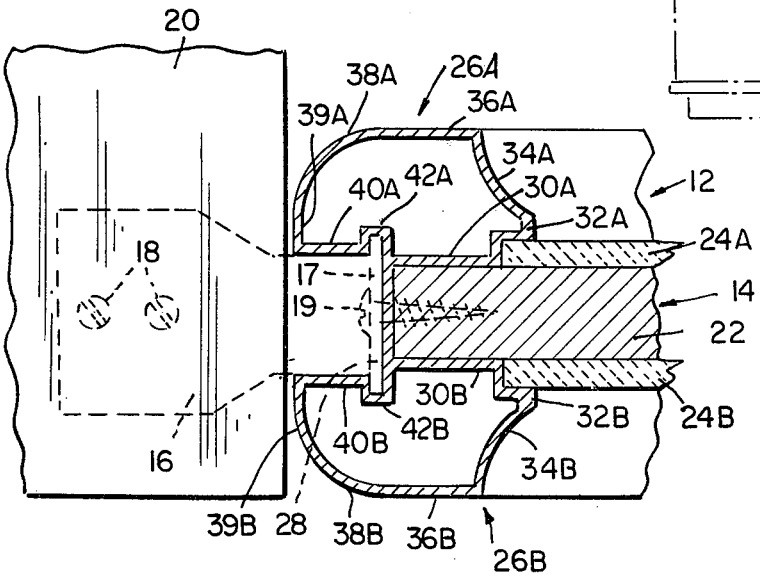
FIG. 3

EDGE MEMBER FOR MIRROR ASSEMBLIES

BACKGROUND OF THE INVENTION

This invention relates to decorative edge extrusions for mirror assemblies and the like. In particular this invention is an improved edge extrusion which has provision for interlocking with adjacent furniture modules.

A search of patent office records show certain prior art patents which bear a remote resemblance to the present invention but do not solve the problem solved by the present invention.

U.S. Pat. No. 3,874,135 to Craven shows a structure 14 and 15 which remotely resembles the present invention although it does not solve the problem solved by the present invention.

In a similar manner, U.S. Pat. No. 3,023,859 to Muessel shows a structure 16 and 17 which is not applicable to the problem solved by the present invention.

It can be seen that the foregoing inventions while similar in structure are not intended, nor can they be applicable to the present invention's problem or solution thereof.

SUMMARY OF THE INVENTION

It is an object of the present invention to provide a decorative edge member for mirror assemblies and the like;

Another object of the present invention is to provide an edge member which will support the mirror assembly;

A further object of the present invention is to provide an edge member which can be joined by locking means to a furniture module or the like;

A still further object of this invention is to provide an economical edge member for finishing the edge of mirror assemblies and the like.

BRIEF DESCRIPTION OF THE DRAWING

The invention will be more clearly understood from the following description of a specific embodiment of the invention, together with the accompanying drawings, in which FIG. 1 is a view of a cabinet system employing the edge member of this invention;

FIG. 2 is a fragmentary sectional and side elevational view of the circled assembly of FIG. 1;

FIG. 3 is a section taken in the direction of arrows 3—3 in FIG. 2.

DETAILED DESCRIPTION OF THE PREFERRED EMBODIMENT

Referring now to the drawings, and more particularly FIG. 1 thereof, there is depicted a mirror and furniture assembly, detail encircled and generally designated 10. The part of FIG. 1 outside of the encircled area 10 is shown for informational purposes only.

FIG. 2 is a side view of the encircled area 10 shown in FIG. 1. Assembly 10 consists of an edge member extrusion piece, generally designated 12, a mirror subassembly generally designated 14 and a mounting bracket 16. Bracket 16 is fastened to a portion of furniture module 20 by a pair of fasteners 18. Part of mounting bracket 16 is a "T" portion 17 (best seen in FIG. 3) which cooperates with edge member 12 and is fastened to member 12 and mirror subassembly 14 by a fstener 19.

FIG. 3 is a sectional view of FIG. 2 viewed in the direction of arrows 3—3 in FIG. 2. Herein the relationships between various parts are better seen. Mirror subassembly 14 is seen to consist of a wood panel support 22 to which is fastened, by means not shown, a pair of mirrors 24A and 24B. Mirror subassembly 14 is connected to one side of edge member 12 and at its other side edge member 12 receives "T" portion 17 part of mounting bracket 16.

Edge member 12 is seen to consist of a pair of shaped members, generally designated 26A and 26B joined together by a connecting web 28. Shaped members 26A and 26B each have one of a pair of first inner straight parts 30A and 30B joined respectively to a pair of "Z"-angle parts 32A and 32B. "Z"-angle parts 32A and 32B are joined respectively to a pair of reverse arcuate parts 34A and 34B which are in turn joined respectively to a pair of outer straight parts 36A and 36B. Outer straight parts 36A and 36B are in turn joined respectively to a pair of arcuate parts 38A and 38B, which arcuate parts 38A and 38B are then joined to one of a pair of tangential straight parts 39A and 29B. Tangential straight parts 39A and 39B are now joined with respective ones of a pair of second inner straight parts 40A and 40B which are then joined respectively to a pair of longer and shorter joined leg-channels 42A and 42B which are respectively joined to a pair of inner straight parts 30A and 30B. Each of the respective foregoing parts cooperate to form one of the pair of shaped members 26A and 26B.

It can be appreciated that the length of edge member 12 is limited only by the capabilities of available extruding machines.

For assembly purposes a pair of mirrors 24A and 24B may be cemented to wood panel 22 which then may be cemented into the appropriate pocket formed in edge member 12. The "Z"-angled portion 32A and 32B of each shaped member 26A and 26B is seen to protect the edges of the respective mirrors. Therefore mirrors having edges which are slightly chipped can be used with edge member 12 resulting in conservation of materials which might otherwise have to be discarded.

Mirror subassembly 14 to which edge member 12 has been attached does not need to be supported by a wall but can be supported as a free standing mirror. Since it now derives its support from mounting bracket 16 having "T"-portion 17 which locks into pockets formed by channel parts 42A and 42B.

Although a preferred method of making edge member 12 is using aluminum extrusions its manufacture may employ plastic as well as other metals. Further, edge member 12 may find applications other than is shown herein.

The embodiment of the invention particularly disclosed and described hereinabove is presented merely as an example of the invention. Other embodiments, forms and modifications of the invention come within the proper scope and spirit of the appended claims; which of course, readily suggest themselves to those skilled in the art.

What is claimed is:

1. An extrusion piece for supporting a panel, comprising:

a pair of shaped members each having;

a first portion having a curved part; and a second portion, said second portion comprising a longer and shorter leg channel, said legs being disposed away from said first portion and having said longer leg joined to one edge of a first inner straight part, and said shorter leg joined to one edge of a second inner straight part, said straight parts being disposed in opposite directions and being parallel to each other, said curved parts being disposed in opposite directions, and each of said second portions being disposed in facing opposition; and a web, said web being disposed between said second portions, whereby one side of said web and said second portions form a pocket for receiving said panel, and the other side of said web and said second portions form a pocket for receiving a mounting bracket for supporting said panel in said extrusion piece, said web being of constant width and being joined with said longer leg of said channel which is part of said pair of second portions; and said first portion comprising a "Z"-angled part having one edge joined to the other edge of said first inner straight part, said "Z" angled part having its other edge joined to said curved part.

2. The extrusion piece of claim 1 wherein:

said first portion comprises:

a reverse arcuate part having one edge joined with the other edge of said "Z"-angled part, said reverse arcuate part having its other edge joined to said curved part.

3. The extrusion piece of claim 2 wherein:

said first member comprises:

an outer straight part having one edge joined with the other edge of said reverse arcuate part, said outer straight having its other edge joined to said curved part.

4. The extrusion piece of claim 3 wherein:

said first portion comprises:

an arcuate part having one edge joined with the other edge of said outer straight part, said arcuate part having its other edge joined to said curved part.

5. The extrusion piece of claim 3 wherein said first part comprises:

a tangential straight part having one edge joined with the other edge of said arcuate part and its other edge joined to the other edge of said second inner straight part.

* * * * *